US006704991B1

(12) United States Patent
Coulborn et al.

(10) Patent No.: US 6,704,991 B1
(45) Date of Patent: Mar. 16, 2004

(54) METHOD FOR FORMING A RAILWAY CAR WITH IMPROVED CROSSTIE CONNECTIONS

(75) Inventors: John W. Coulborn, Fort Worth, TX (US); Don P. Nguyen, Flower Mound, TX (US); Stephen W. Smith, Dallas, TX (US)

(73) Assignee: TRN Business Trust, Dallas, TX (US)

( * ) Notice: Subject to any disclaimer, the term of this patent is extended or adjusted under 35 U.S.C. 154(b) by 0 days.

(21) Appl. No.: 09/551,244

(22) Filed: Apr. 17, 2000

Related U.S. Application Data

(60) Provisional application No. 60/160,552, filed on Oct. 20, 1999.

(51) Int. Cl.[7] ..... B23P 11/00; B23P 17/00; B23K 31/00

(52) U.S. Cl. ..... 29/525.14; 29/525.01; 29/525.13; 29/525.02; 228/135

(58) Field of Search ..... 29/525.01, 428, 29/525.14, 525.13, 525.02; 228/135, 170; 403/271, 272

(56) References Cited

U.S. PATENT DOCUMENTS

| | | | | |
|---|---|---|---|---|
| 874,044 A | | 12/1907 | Wahlert | |
| 1,741,188 A | | 12/1929 | Goodwin et al. | |
| 4,294,439 A | * | 10/1981 | McIntosh | 267/54 |
| 4,750,431 A | | 6/1988 | Yates et al. | 105/4.1 |
| 4,782,762 A | | 11/1988 | Johnstone et al. | 137/355 |
| 4,805,539 A | | 2/1989 | Ferris et al. | 105/335 |
| 5,054,403 A | | 10/1991 | Hill et al. | 105/419 |
| 5,074,725 A | | 12/1991 | Pavlick | 410/54 |
| 5,085,152 A | | 2/1992 | Tylisz et al. | 105/419 |
| 5,279,230 A | | 1/1994 | Thomas et al. | 105/355 |
| 5,379,702 A | | 1/1995 | Saxton et al. | 105/355 |
| 5,423,269 A | | 6/1995 | Saxton et al. | 105/355 |
| 5,465,670 A | | 11/1995 | Butcher | 105/355 |
| 5,562,046 A | | 10/1996 | Fetterman et al. | 105/419 |
| 5,611,285 A | | 3/1997 | Saxton | 105/355 |
| 5,730,063 A | | 3/1998 | Forbes et al. | 105/355 |
| 5,918,549 A | | 7/1999 | Basile et al. | 105/422 |

OTHER PUBLICATIONS

Trinity Industries, Inc. Railcar Division Specification No. F–3–5741 "125 Ton Three Unit Articulated 53 Foot Well Car," pp. 1–15, Oct. 22, 1998.

File History on Patent Application 2,146,709 entitled *A Retractable Guide Assembly For Changing The Effective Width of a Railroad Freight Car Container Well* by National Steel Car Limited Filed Apr. 10, 1995.

* cited by examiner

*Primary Examiner*—John C. Hong
(74) *Attorney, Agent, or Firm*—Baker Botts L.L.P.

(57) ABSTRACT

A connection or weld attachment and method are disclosed for use in connecting a first structural member with a second structural member. An end plate is preferably attached to one end of the first structural member. The end plate and first structural member may then be attached by mechanical fasteners and at least one weld to the second structural member. A railway car having an underframe defined in part by a pair of side sills and a plurality of crossties may be formed with this mechanical connection. The end plate may be attached to a first leg which is in turn attached to the respective crosstie. The first leg preferably increases in width extending from the crosstie to the end plate. The mechanical fasteners are preferably disposed at opposite ends of the weld to minimize possible fatigue cracking and to increase the life of the associated connection.

9 Claims, 3 Drawing Sheets

METHOD FOR FORMING A RAILWAY CAR WITH IMPROVED CROSSTIE CONNECTIONS

RELATED APPLICATIONS

This application claims the benefit of previously filed provisional application Ser. No. 60/160,552 filed Oct. 20, 1999 entitled Railway Car with Improved Crosstie Connections.

TECHNICAL FIELD OF THE INVENTION

This invention relates to a railway car having crosstie connections with improved fatigue life and more particularly to an apparatus and method which reduce or eliminate stress related fatigue cracks in an associated weld between two structural members joined to each other at approximately a right angle.

BACKGROUND OF THE INVENTION

All railroads have a maximum limit on the total amount of weight which may be safely placed upon the associated railway tracks. The total load carrying capability of railway tracks and railway cars may vary substantially depending upon various design parameters. Since there are other limits as to the total amount of weight which may be safely supported by a pair of tracks, there is a continuous ongoing desire within the railway industry to increase the weight of cargo or lading which may be transported within a railway car while at the same time reducing the unloaded or "light weight" of the respective railway car. Many railway cars used to transport freight often have a railway car underframe defined in part by a pair of side sills and a pair of end sills joined with each other in a generally elongated, rectangular configuration.

One or more transverse members may be attached to the side sills and spaced from each other intermediate the end sills. Such transverse members are typically provided to support the side sills and/or cargo carried by the associated railway car. For some applications such as well cars, transverse members which support cargo or lading are sometimes referred to as crossbearers. Transverse members which support associated side sills may sometimes be referred to as crossties.

During the past several years, railway cars have been developed for use in transporting various types of containers associated with intermodal transportation systems. Such railway cars often have a depressed floor section disposed between a pair of longitudinally extending side structures and transverse end structures. Such railway cars may sometimes be referred to as well cars. Multiple transverse members or crossties are typically disposed between the longitudinal side structures and spaced from each other intermediate the associated end structures. Some of the transverse members, often referred to as "loadbearing cross members or crossbearers" may be used to support containers or other types of lading carried within such well cars. Other transverse members, often referred to as crossties, may be used to provide structural support for the associated longitudinal side structures and more particularly the associated side sills. U.S. Pat. No. 4,805,539 entitled "Well Car End Structure Having Frameless Radial Truck" and U.S. Pat. No. 5,562,046 entitled "Load Bearing Cross Bearer Connection" provide examples of such well cars and associated transverse members.

Well cars may sometimes be described as a flatcar with a depression or opening in the center to allow the load to extend below the normal floor level so that the load will not extend above applicable overhead clearance limits. The configuration of a typical well car generally results in the lading or cargo placing multi-directional loads on the associated side sills. Crossties are often provided to cooperate with the side sills to distribute and transmit loads associated with transporting lading by the well car. These loads typically cause relatively high stresses in the structural components of the side sill and crossties. Often welds are formed between the ends of a typical crosstie and respective portions of the side sills of the railway car. The configuration of the end of a typical crosstie and adjacent portion of a side sill frequently results in notches being formed at the end of one or more welds used to connect the crosstie with the side sill. The notches may function as stress risers which in combination with relative high stresses present in the side sill substantially reduce the fatigue life of the associated weld and compromise the integrity of the connection formed between the crosstie and side sill.

Various types of mechanical fasteners, fittings and welding techniques have been used to join a first structural member to a second structural member at an angle of approximately ninety degrees relative to each other. For some applications an appropriately sized end plate has been attached to one end of a first structural member for use in providing a desired connection with a second structural member.

SUMMARY OF THE INVENTION

The present invention includes an apparatus and method to form a weld attachment between two structural members joined to each other at approximately a right angle and minimizes potential for fatigue cracking of an associated weld. Transverse members of a railway car underframe and associated side sills are examples of such structural members.

One aspect of the present invention includes a transverse member or crosstie having end plates incorporating teachings of the present invention secured to opposite ends thereof for use in connecting the crosstie with respective portions of an associated railway car side sills. The end plates are preferably substantially enlarged as compared to the cross section of the associated transverse member to increase the amount of weld contact between the resulting weld attachment and respective portions of the side sills. The configuration and size of the end plates and resulting weld attachment are preferably selected, in accordance with teachings of the present invention, to minimize the effects of any abrupt change in cross section between the transverse member and the side sills.

For one embodiment a railway car is provided with a plurality of weld attachments having end plates and respective bolts extending through the end plates and adjacent portions of the railway car. Coupling a respective bolt to the end plate and adjacent portions of the railway car proximate each end of the associated weld attachment substantially reduces or eliminates stress risers, and thus reduces or eliminates any tendency for one or more fatigue cracks to develop in the vicinity of an associated weld. When loads are transferred between a first structural member such as a crosstie and a second structural member such as a side sill, the bolts will preferably absorb or pickup a substantial amount of the load being transferred and reduce peak stresses at the ends of the associated weld. The present invention allows a weld attachment and associated weld to join a crosstie with an associated side sill in a manner that substantially reduces or eliminates any potential for fatigue cracking of the weld.

Technical benefits include using an end plate formed as part of a press fitting in accordance with teachings of the present invention to provide a weld attachment or weldment which substantially increases the fatigue life of an associated weld. The end plate may also be formed as a part of a casting or forging to provide a weld attachment or weldment incorporating teachings of the present invention. The present invention allows selecting the optimum configuration and dimensions for an end plate and resulting weld attachment to minimize stress risers and any corresponding tendency of an associated weld to develop one or more fatigue cracks. For one embodiment the pressed fitting is preferably flared along each side to provide increased weld area and to also reduce the effect of any abrupt change in cross section between a first structural member connected to a second structural member at approximately a right angle.

BRIEF DESCRIPTION OF THE DRAWINGS

For a more complete understanding of the present invention, and the advantages thereof, reference is now made to the following written description taken in conjunction with the accompanying drawings, in which.

DETAILED DESCRIPTION OF THE INVENTION

Preferred embodiments of the present invention and its advantages are best understood by referring to FIGS. 1–5 of the drawings, like numerals being used for like and corresponding parts of the various drawings.

Figure 1:
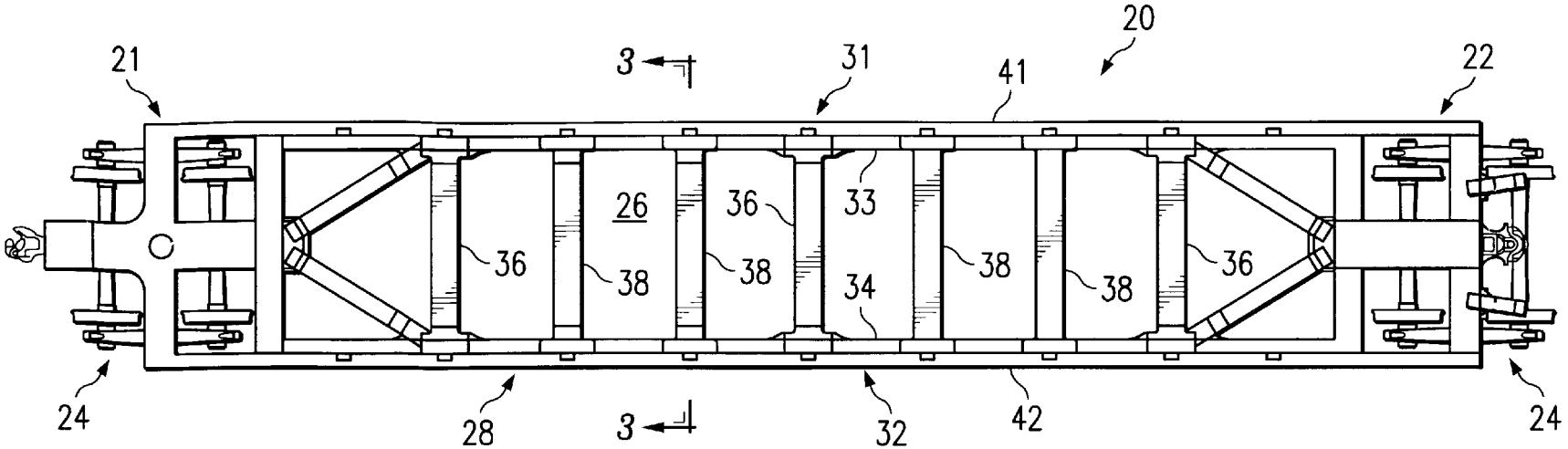
FIG. 1 is a schematic drawing showing a plan view of one unit of a railway car incorporating teachings of the present invention.
Figure 2:
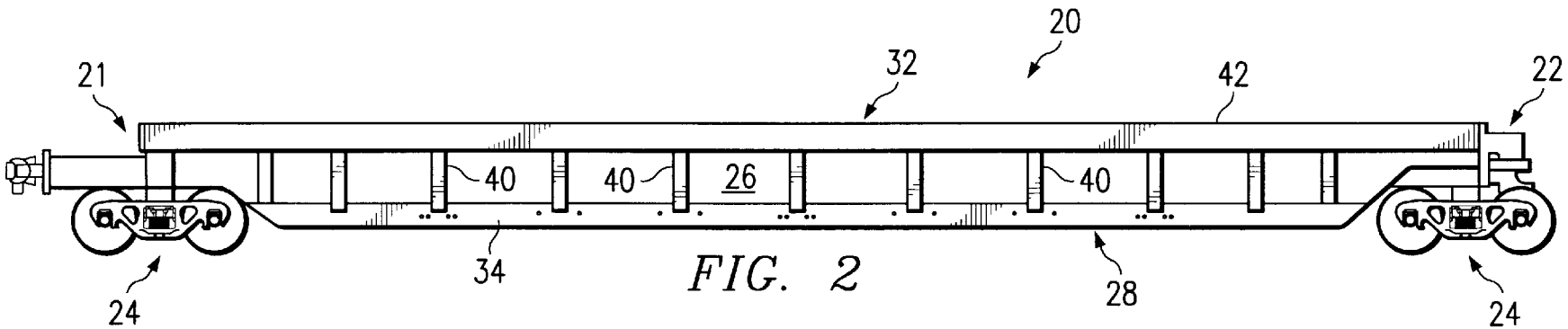
FIG. 2 is a schematic drawing in elevation showing a side view of the unit of the railway car of FIG. 1.

Railway car 20 incorporating teachings of the present invention is shown in FIGS. 1 and 2. Railway car 20 may be generally described as a "well car" satisfactory for carrying cargo containers (not expressly shown) used in intermodal transportation systems or other types of lading. For some applications railway car 20 incorporating teachings of the present invention may represent one unit of a multiple unit articulated well car. For other applications railway car 20 may represent a single unit well car. Therefore, railway car 20 may include coupling assemblies and railway car trucks appropriate for an articulated railway car or alternatively coupling assemblies and trucks appropriate for a single unit well car. Railway car 20 may be designed to accommodate a single stack or a double stack of cargo containers.

For one application railway car or well car 20 may represent one unit of a three unit articulated railway car (not expressly shown) having weld attachments formed in accordance with teachings of the present invention to connect a plurality of crossties with selected portions of associated side sills. For this application well car 20 may be designed to meet the requirements of the Association of American Railroads (AAR) Clearance Plate H plus one inch and associated structural design specifications. Well car 20 may also be designed such that the lowest portion of well car 20 is no closer than two and three quarters of an inch above the top of the associated rails as determined by applicable AAR specifications.

Railway car 20 preferably includes end assemblies 21 and 22 with respective side assemblies 31 and 32 attached to and extending longitudinally between end assemblies 21 and 22. End assemblies 21 and 22 are mounted on respective railway car trucks 24. Side assemblies 31 and 32 are preferably spaced laterally from each other and extend generally parallel with each other between end assemblies 21 and 22. Side assemblies 31 and 32 cooperate with end assemblies 21 and 22 to define, in part, cargo carrying space 26 disposed therebetween. A portion of cargo carrying space 26 is depressed or extends below the normal floor level typically associated with a railway car having trucks 24. The configuration and dimensions associated with end assemblies 21 and 22 and side assemblies 31 and 32 are preferably selected to provide cargo carrying area 26 which is compatible with applicable overhead clearance limits and the type of containers or other lading which will be transported by railway car 20.

Various components of end assemblies 21 and 22 and side assemblies 31 and 32 are attached to and/or from a portion of railway car underframe 28. Two of these components include side sills 33 and 34. A plurality of transverse members such as load bearing cross members or crossbearers 36 and crossties 38 are preferably attached to and extend laterally between side sills 33 and 34. Transverse members 36 and 38 are preferably spaced longitudinally from each other and end assemblies 21 and 22. The number, size and location of transverse members 36 and 38 is dependent upon the load carrying capacity and applicable AAR specifications for railway car 20. Crossbearers 36 often include one or more container supports and/or guides (not expressly shown) for securing one or more containers (not expressly shown) at a desired location within cargo space 26.

Side assemblies 31 and 32 are preferably attached to and extend longitudinally along respective side sills 33 and 34. A plurality of side stakes 40 extend vertically from respective side sills 33 and 34 and top chords 41 and 42. For some applications, top chords 41 and 42 may be described as hollow, elongated metal tubes having a generally rectangular cross section. For the embodiment shown in FIGS. 1, 2 and 3, side stakes 40 may also be described as hollow, channels having a generally U-shaped cross section. The length of each side stake 40 is defined in part by the distance between side sills 33 and 34 and respective top chords 41 and 42. For purposes of describing various features of the present invention, the wall or portion of each side stake 40 immediately adjacent to cargo space 26 has been designated 126. The wall or portion of each side stake 40 opposite from cargo space 26 has been designated 127.

Figure 3:
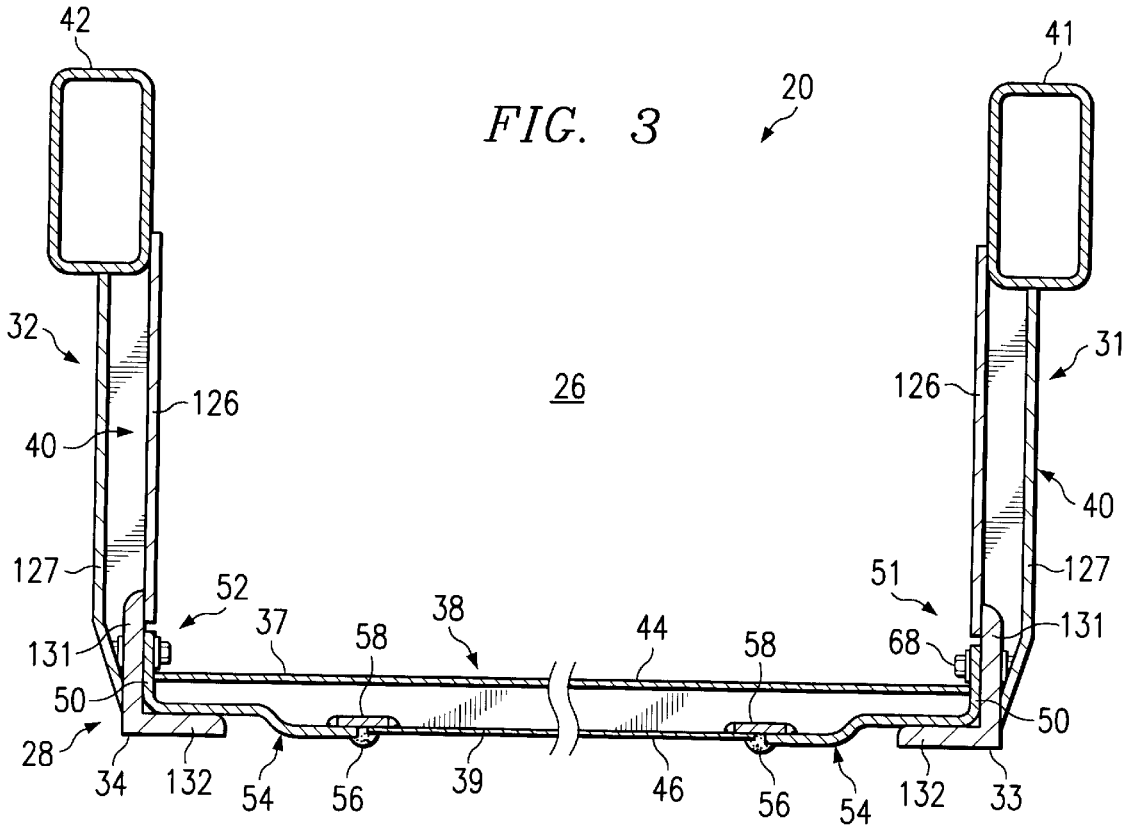
FIG. 3 is a schematic drawing in section with portions broken away taken along lines 3—3 of FIG. 1.

FIG. 3 is a schematic drawing with portions broken away showing a cross section of side wall assemblies 31 and 32 along with one of the crossties 38. The number, dimensions, configuration and materials used to form crossties 38 are selected to provide desired structural support for the associated side sills 33 and 34. Connections or weld attachments 51 and 52 are preferably formed, in accordances with teachings of the present invention, between respective ends of each crosstie 38 and selected portions of side sills 33 and 34. Connections 51 and 52 on each crosstie 38 preferably have substantially the same configuration and dimensions. Therefore, only connection or weld attachment 51 will be discussed in detail.

Figure 4:
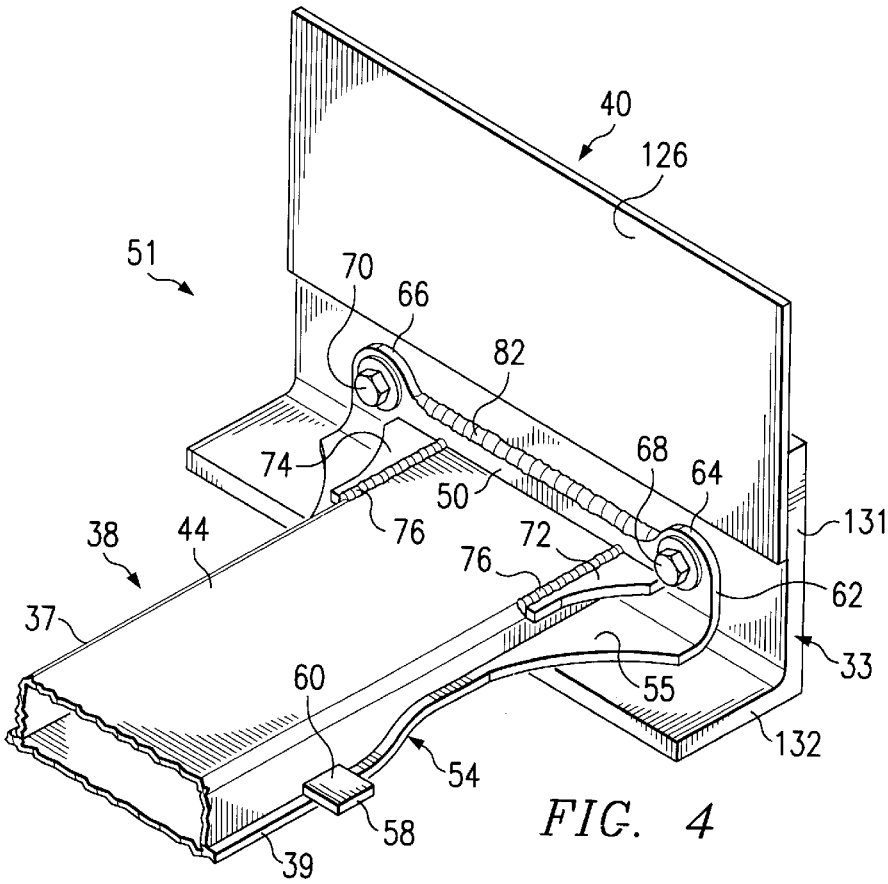
FIG. 4 is a schematic drawing showing an isometric view with portions broken away of a crosstie member having a weld attachment or weldment disposed on one end thereof and connected to a selected portion of a side sill in accordance with teachings of the present invention.
Figure 5:
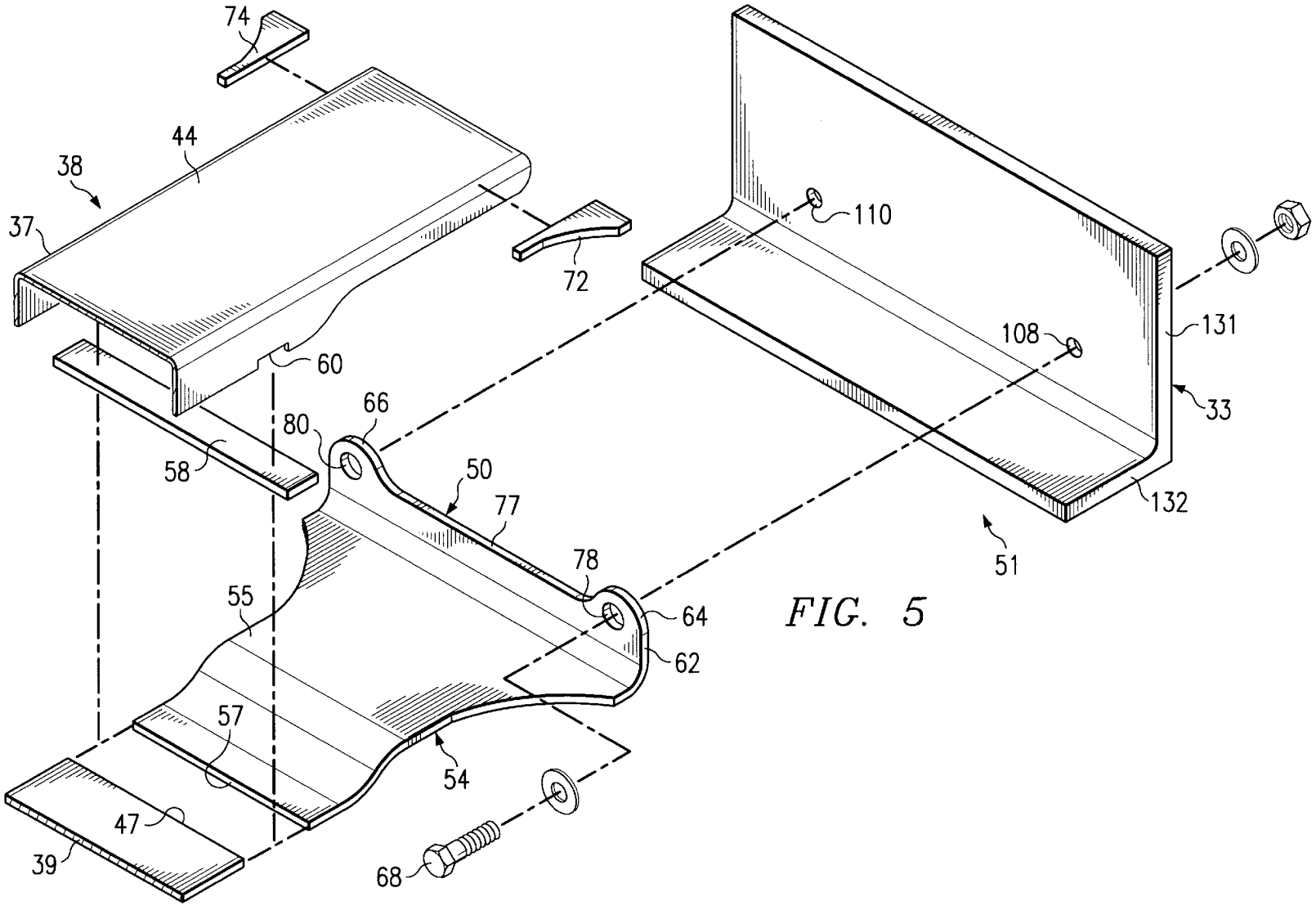
FIG. 5 is an isometric drawing showing an exploded view with portions broken away of the connection between the crosstie member and side sill of FIG. 4.

For the embodiment of the present invention [as] shown in FIGS. 3, 4 and 5, crosstie 38 may be generally described as a hollow metal tube having a generally rectangular cross section. Respective end plates 50 incorporating teachings of the present invention are preferably attached to opposite ends of crosstie 38. As discussed later in more detail, each end plate 50 is preferably attached to a selected portion of respective side sills 33 and 34 by mechanical fasteners and at least one weld.

First surface or top surface 44 of crosstie 38 extends between selected portions of side sills 33 and 34. The length of top surface 44 plus the thickness of the associated end plate 50 is approximately equal to the lateral distance between side sills 33 and 34. Second surface or bottom surface 46 of crosstie 38 is preferably reduced in length to allow respective press fittings 54, with end plate 50 formed as an integral component thereof to be attached to the end of crosstie 38. For some applications, end plate 50 may be formed as an integral part of a casting or forging (not expressly shown) having dimensions and a configuration corresponding generally with press fitting 54. For still other applications, an end plate incorporating teachings of the present invention may be attached to a crosstie using various types of inserts, fasteners and welding procedures associated with the railway car manufacturing industry.

For some applications such as those shown in FIGS. 3, 4 and 5, crossties 38 may be formed from an elongated strip of metal having a generally U-shaped cross section hereinafter referred to as U shaped channel 37. Cover plate 39 having a length less than the length of the associated crosstie 38 may be attached to the open portion of U-shaped channel 37 to provide second surface or bottom surface 46. The length of the cover plate 39 is preferably selected to be compatible with attaching respective press fittings 54 to opposite ends of crosstie 38. For other applications, crossties 38 may be formed from hollow elongated metal tubes having a generally rectangular cross section. For the embodiment of the present invention [as] shown in FIGS. 3, 4 and 5, the elongated strip of metal used to form U shaped channel 37 may have a thickness of approximately one-quarter of an inch. Cover plate 39 may have a thickness of approximately three-sixteenths of an inch and press fittings 54 may have a thickness of approximately three-eighths of an inch.

During the assembly of press fitting 54 with the respective end of crosstie 38, butt weld 56 is preferably formed between end 47 of cover plate 39 and end 57 of press fitting 54. See FIGS. 3 and 5. Backup bar 58 is preferably disposed immediately adjacent to ends 47 and 57 to assist in forming butt weld 56. For the embodiment of the present invention shown in FIGS. 4 and 5, notches 60 are preferably formed in U shaped channel 37 at a location corresponding with the desired location for butt weld 56. As previously noted various manufacturing procedures and techniques associated with the railway car manufacturing industry may be satisfactorily used to form a crosstie for use with the present invention. The present invention is not limited to crossties 38 as shown in FIGS. 3, 4 and 5.

For the embodiment of the present invention shown in FIGS. 3, 4 and 5, press fitting 54 may be described as having a generally L-shaped configuration with end plate 50 formed as an integral part thereof. For purposes of explaining various features of the present invention, press fitting 54 may be described as having a first leg 55 and a second leg extending therefrom which corresponds generally with end plate 50. End 57 of first leg 55 is preferably formed with dimensions corresponding generally with the dimensions of end 47 on cover plate 39 of crosstie 38. For the embodiment shown in FIG. 5, the width of end 57 of press fitting 54 is approximately equal to the width of the associated crosstie 38. However, the width of end plate 50, formed in accordance with teachings of the present invention is substantially larger than the width of the associated crosstie 38. Also, the width of first leg 55 of press fitting 54 preferably increases substantially between end 57 and end plate 50.

The increased width of first leg 55 results in press fitting 54 having a generally flared configuration extending from crosstie 38. As a result of flaring the sides of first leg 55 and increasing the width of end plate 50 as compared to the width of crosstie 38, a substantially larger weld 82 may be formed as part of connection 51. Also, flaring the sides of first leg 55 reduces or minimizes any effect of abruptness in the change in cross section between crosstie 38 and side sill 33. These features of the present invention result in increased fatigue life for the associated connection or weld attachment 51.

For the embodiment of the present invention as best shown in FIGS. 3, 4 and 5, side sills 33 and 34 preferably have a generally L-shaped configuration. For purposes of describing various features of the present invention, the respective legs of side sill 33 have been designated 131 and 132. The configuration of first leg 55 and end plate 50 of press fitting 54 are preferably selected to be compatible with the configuration of legs 131 and 132 of side sill 33.

Enlargements 64 and 66 are preferably formed on opposite sides of end plate 50 and spaced from the end of crosstie 38. The dimensions and configuration of enlargements 64 and 66 are preferably selected to be compatible with forming respective holes 78 and 80 therein to receive bolts 68 and 70. Enlargements 64 and 66 also cooperate with each other to form recessed area 77 extending therebetween. For the embodiment of the present invention [as] shown in FIGS. 3,4 and 5, leg 131 of side sill 33 preferably includes respective holes 108 and 110 which are sized to receive bolts 68 and 70. Holes 108 and 110 are preferably formed at the selected location for forming connection 51 between crosstie 38 and side sill 33.

After press fitting 54 is attached to the end of crosstie 38 using butt weld 56, a pair of gussets 72 and 74 are preferably attached to the exterior of crosstie 38 immediately adjacent to end plate 50. For the embodiment of the present invention [as] shown in FIGS. 4 and 5, gussets 72 and 74 have an irregular configuration which somewhat resembles a triangle. However, gussets having a wide variety of configurations may be satisfactorily used with the present invention. Respective welds 76 may be used to attach gussets 72 and 74 at the desired location on opposite sides of crosstie 38 adjacent to end plate 50. Gussets 72 and 74 are also preferably spaced from first leg 55 of press fitting 54. Gussets 72 and 74 cooperate with each other to provide a generally flared or expanded cross section for crosstie 38 adjacent to end plate 50 and side sill 33.

The end of crosstie 38 with press fitting 54 attached thereto, in accordance with teachings of the present invention, is preferably placed on leg 132 of crosstie 38 at the selected location. Mechanical fasteners 68 and 70 may be placed through respective holes 78 and 80 in end plate 50 and holes 108 and 110 in side sill 33. For the embodiment shown in FIGS. 3, 4 and 5, mechanical fasteners 68 and 70 are bolts. For some applications, other types of mechanical fasteners such as Huck® fasteners may be used instead of bolts. After end plate 50 has been securely attached to the selected portion of side sill 33, using mechanical fasteners 68 and 70, or other satisfactory types of mechanical fasteners, at least one weld 82 may then be formed in recessed area 77 between enlargements 64 and 66 and adjacent portions of side sill 33.

Mechanical fasteners 68 and 70 are preferably located proximate the ends of weld 82 in accordance with teachings of the present invention such that mechanical fasteners 68 and 70 will be subjected to fatigue cycling and loading before such loads are transferred to weld 82. When loads are transferred between a first structural member and a second structural member, mechanical fasteners 68 and 70 preferably absorb or pick up a substantial portion of the load to be transferred before the load is applied to adjacent ends of weld 82. Thus, mechanical fasteners 68 and 70 substantially reduce peak stress at adjacent ends of weld 82 during load transfer between the first structural member and the second structural member.

The size, location and configuration of holes 78 and 80 are preferably selected such that mechanical fasteners 68 and 70 will be generally aligned with and disposed proximate to opposite ends of weld 82. Mechanical fasteners 68 and 70 are preferably loaded or torqued such that during movement of railway car 20 loads associated with fatigue cycling of the respective connection or weld attachment 51 will generally be transferred to mechanical fasteners 68 and 70. Thus, end plate 50 and mechanical fasteners 68 and 70 cooperate with each other to substantially reduce or eliminate fatigue cycling at the ends of weld 82. Also, the configuration of enlargement 64 and 66 cooperate with recessed area 77 and mechanical fasteners 68 and 70 to minimize any stress risers at the end of weld 82. The previously described flared or gradual change in cross section between crosstie 38 and adjacent portions of side sill 33 provided by first leg 55 and gussetts 72 and 74 also helps reduce the magnitude of fatigue cycling and increases the life of connection or weld attachment 51.

The present invention has been described with respect to railway car 20. However, an apparatus and methods incorporating teachings of the present invention may be used with a wide variety of railway cars used to carry freight and is not limited to well cars. Also, methods and apparatuses incorporating teachings of the present invention may be used to form a weld attachment between any two structural members disposed at right angles when loads being transferred between the structural members may result in potential fatigue cracking.

Although the present invention and its advantages have been described in detail it should be understood that various changes, substitutions, and alterations can be made hereto without departing from the spirit and scope of the invention as defined by the following claims.

What is claimed is:

1. A method for attaching one end of a first structural member to a selected portion of a second structural member, the second structural member comprising a structural member of a railcar and the first structural member extending at an angle of approximately ninety degrees relative to the second structural member comprising:

forming at least two holes in the second structural member at the selected portion with the holes spaced from each other and sized to receive respective mechanical fasteners;

forming an end plate with a width larger than the one end of the first structural member;

forming a first enlargement and a second enlargement on the end plate spaced from each other with a recess disposed between the first enlargement and the second enlargement;

forming the recess with dimensions and a configuration selected to accommodate forming a weld between the end plate and the selected portion of the second structural member;

forming a respective hole in each enlargement of the end plate with each hole having dimension and a configuration corresponding respectively with one of the holes formed at the selected location in the second structural member;

attaching the end plate to the one end of the first structural member;

placing the first structural member adjacent to the second structural member with the holes in the enlargements of the end plate respectively aligned with the holes in the second structural member;

inserting respective mechanical fasteners through the holes to connect the end plate and the first structural member to the selected portion of the second structural member; and forming at least one weld in the recess of the end plate to further connect the end plate and the first structural member to the selected portion of the second structural member.

2. The method of claim 1 further comprising forming the end plate as an integral part of a press fitting with a portion of the press fitting extending from the end plate.

3. The method of claim 1 further comprising forming the end plate as an integral part of a forging with a portion of the forging extending from the end plate.

4. The method of claim 1 further comprising forming the end plate as an integral part of a casting with a portion of the casting extending from the end plate.

5. A method for forming a railway car underframe defined in part by pair of side sills with a plurality of crossties respectively connected to and extending between selected portions of the side sills comprising:

forming at least two holes in each side sill at the selected portion with the holes spaced from each other and sized to receive respective mechanical fasteners;

forming an end plate having a width larger than a width of the respective crosstie;

forming a first enlargement and a second enlargement on each end plate spaced from each other to define in part a recess disposed therebetween;

forming the first enlargement, the second enlargement and the recess of each end plate with dimensions and a configuration selected to accommodate welding the end plate to the selected portion of the respective side sill;

forming a respective hole in each enlargement of the end plate with each hole having dimensions and a configuration corresponding generally with the respective holes at the selected portion of the respective side sill;

attaching each end plate to a respective end of one of the crossties;

placing the crossties and attaching the end plates adjacent to the respective holes at the selected portions of the side sills;

installing respective mechanical fasteners through the holes in the end plates and the side sills; and forming at least one weld in the recess of each end plate to further connect associated crosstie to the selected portions of the side sills.

6. The method of claim 5 further comprising forming the end plate as an integral part of a press fitting with a portion of the press fitting extending from the end plate.

7. The method of claim 5 further comprising forming the end plate as an integral part of a forging with a portion of the forging extending from the end plate.

8. The method of claim 5 further comprising forming the end plate as an integral part of a casting with a portion of the casting extending from the end plate.

9. The method of claim 5 further comprising forming the holes in enlargements of each end plate adjacent to and generally aligned with opposite ends of associated recess whereby the mechanical fasteners cooperate with each other and the end plates to improve the fatigue life of the associated welds.

* * * * *